US009146047B2

(12) United States Patent
Huang

(10) Patent No.: US 9,146,047 B2
(45) Date of Patent: Sep. 29, 2015

(54) INTEGRATED STIRLING REFRIGERATOR

(75) Inventor: Li Huang, Hubei (CN)

(73) Assignee: Wuhan Guide Infrared Co., Ltd., Wuhan (CN)

( * ) Notice: Subject to any disclaimer, the term of this patent is extended or adjusted under 35 U.S.C. 154(b) by 334 days.

(21) Appl. No.: 13/698,033

(22) PCT Filed: Aug. 27, 2010

(86) PCT No.: PCT/CN2010/076434
§ 371 (c)(1),
(2), (4) Date: Nov. 14, 2012

(87) PCT Pub. No.: WO2011/143862
PCT Pub. Date: Nov. 24, 2011

(65) Prior Publication Data

US 2013/0061606 A1 Mar. 14, 2013

(30) Foreign Application Priority Data

May 18, 2010 (CN) ..... 2010 2 0202975 U

(51) Int. Cl.
*F25B 9/14* (2006.01)

(52) U.S. Cl.
CPC ..... *F25B 9/14* (2013.01); *F25B 2309/001* (2013.01)

(58) Field of Classification Search
CPC ..... F25B 2309/001
USPC ..... 62/6, 228.1; 60/517
See application file for complete search history.

(56) References Cited

U.S. PATENT DOCUMENTS

| | | | | |
|---|---|---|---|---|
| 3,220,201 | A * | 11/1965 | Heuchling et al. | 62/6 |
| 5,088,288 | A * | 2/1992 | Katagishi et al. | 62/6 |
| 5,113,662 | A * | 5/1992 | Fujii et al. | 62/6 |
| 5,177,971 | A * | 1/1993 | Kiyota | 62/6 |
| 7,257,949 | B2 * | 8/2007 | Shimizu et al. | 60/517 |

* cited by examiner

*Primary Examiner* — Emmanuel Duke
(74) *Attorney, Agent, or Firm* — Fenwick & West LLP

(57) ABSTRACT

An integrated Stirling refrigerator is composed of two parts: a compressor and an expander. The compressor is composed of a shell (1), a piston (4), a leaf spring (8), a magnet (9), a coil (10), a bracket (14) and a support shelf (15). The shell (1) of the compressor includes two cylinders (11, 12), one of which is set inside the other to form a compression chamber (3). The piston (4) is connected with the leaf spring (8). The coil (10) is fixed between the inside of the shell (1) and the bracket (14), and the magnet (9) is fixed between the bracket (14) and the support shelf (15), wherein the bracket (14) and the support shelf (15) are respectively connected with the shell (1). The inside of the expander is divided into two chambers by a small piston and a regenerator (7) fixed together, that is, an expansion chamber (6) and a pneumatic chamber, and a cylindrical spring (16) is provided on the bottom of the expander. The center of the compressor is designed as a groove, and the expander is inserted into the groove of the compressor. There is a small hole designed on the bottom of the expander, which is communicated with the compression chamber (3) of the compressor. The Stirling refrigerator has the advantages of compact structure and small volume, and hence it can be widely used.

1 Claim, 1 Drawing Sheet

INTEGRATED STIRLING REFRIGERATOR

FIELD OF THE INVENTION

The present invention relates to a Sterling cryocooler, and particularly to a structurally compact and smaller integrated Sterling cryocooler.

BACKGROUND OF THE INVENTION

Sterling cryocoolers are active-type cryocoolers employing inverse sterling circulation. Philips laboratory of Holland manufactured a pragmatic micro sterling circulation cryocooler for the first time in 1954, which could produce 580 W refrigeration capacity at 77 k. Such compactly structured Sterling cryocooler exhibited an attractive potential in industrial and military applications very soon. With improved technological levels and processing techniques, people use a highly efficient cool storing material, a precise clearance sealing technology, a flexible bearing design and advanced electronic technologies so that the Sterling cryocooler becomes very reliable, wearable and adapted for the cooling of low-temperature electronic devices, infrared detectors, superconductive devices and so on, and plays an important role in military and civil equipment such as missile guidance, infrared forward looking and night vision instruments and thermal imager.

Sterling cryocoolers in an early stage integrate a compression portion with an expansion refrigeration portion, and a compression piston and a displacer thereof convert a rotary movement of a motor into a simple harmonic movement of the piston via a crank linkage mechanism. A working medium flows alternately to and fro in the portions such as a compression space, a regenerator and an expansion space, without the mass of a gas changed, which forms a closed-type circulation. There are no valves in the machine for Sterling circulation so that an internal irreversible loss is small, so the machine exhibits a high efficiency, a compact structure, a small size and a light weight. However, the rotary movement of the machine causes a great vibration and a large noise. Except Philips cryocoolers for manufacturing liquid nitrogen and liquid hydrogen, Sterling cryocoolers have been developing in a tendency to miniaturization and longer service life to achieve highly efficient refrigeration in a liquid nitrogen temperature zone. These machines are mainly classified into integral type and separate type from structure so as to meet the requirements of many ground and spatial applications.

In tactical type Sterling cryocooler products in ground application, there are usually two types: a slip-on type and an integrated Dewar cryocooler assembly. Displacers of conventional cryocoolers are mostly disposed in a cylinder of a thin-walled stainless steel tube, a tiny clearance is provided between the displacer and the sleeve wall so as to ensure a contactless movement of the displacer and the cylinder wall, and presence of the sleeve cylinder allows the cryocooler to become an independent closed system. Hence, such structure is called a slip-on structure. A drawback of such slip-on structure is that when a cold finger of the cryocooler is cooled from 300 k to 77 k, a temperature gradient in a range of 300 K-77 K occurs on a sleeve of the displacer, and thermal conductance loss of the wall of the sleeve causes an effective refrigeration capacity of the cold finger to reduce. The integrated Dewar cryocooler assembly (IDCA) refers to a cryocooler assembly integrating a Dewar with a sensor. In view of the drawback of the slip-on structure with a sleeve, an inner cylinder of the Dewar is directly produced as a cylinder sleeve of the displacer, thereby omitting the outer sleeve of the conventional displacer, and obviating the thermal conductance loss of the sleeve wall to increase the effective refrigeration capacity of the sensor. Obviously, the integrated Dewar cryocooler assembly not only improves the thermal efficiency but also makes the system compactly-structured and reduced in size and weight, which is crucial to some applications.

SUMMARY OF THE INVENTION

An object of the present invention is to provide a structurally compact and smaller integrated Sterling cryocooler, wherein an expander is embedded in a compressor to form an integrated whole. This integrated Sterling cryocooler is more structurally compact, more small-sized and more convenient for large volume applications.

The technical solution of the present invention is as below:

An integrated Sterling cryocooler, comprising two portions, namely, a compressor and an expander, wherein the compressor comprises a housing, a piston, a plate spring, a magnet, a coil, a bracket and a support, the housing of the compressor is designed in a way that an outer housing is provided around outside an inner housing to form a compression cavity, the piston is connected to the plate spring to support a reciprocating movement of the fixed piston, the coil is fixed between the interior of the housing and the bracket, the magnet is fixed between the bracket and the support, the bracket and the support are respectively connected to the housing, an electromagnetic force is generated between the coil and the magnet to drive the piston into reciprocating movement; an interior of the expander is divided into two chambers, namely, an expansion chamber and a pneumatic chamber by a small piston and a heat regenerator which are fixed together, a cylindrical spring is disposed at a bottom of the expander, compressed gas pushes the heat regenerator on the small piston into reciprocating movement between the pneumatic chamber and the expansion chamber, the heat regenerator is in a clearance labyrinth sealing with a cold finger, a supporting element for pushing the small piston is the cylindrical spring, characterized in that a groove is designed at a center of the compressor, the expander is embedded in the groove of the compressor, an orifice is designed on the bottom of the expander so as to be communicated with the compression cavity of the compressor.

Since an expander used in a Sterling cryocooler needs to be interconnected to a micro Dewar component in use, the groove at the center of the compressor needs to be sized enough to embed a commonly-used micro Dewar component.

The present invention makes improvements to internal structures and components of a conventional compressor to form a groove in the middle of the compressor. First, an improvement is made to the structure of the compression cavity: a conventional compression cavity is a cylindrical structure and connected to the expander via a thin gas pipeline, whereas in the present invention, a groove is designed at the center of the compressor, and the expander is embedded in the groove so that the compression cavity of the compressor is communicated with an orifice on the bottom of the embedded expander.

The improved small-sized integrated Sterling cryocooler according to the present invention is substantially different from the conventional integrated Sterling cryocooler in that the structure is compacter. A typical Sterling cryocooler is shaped and sized so that the compressor is Φ50 mm×200 mm, and an expander cold finger is Φ10 mm×60 mm. The expander and the compressor are substantially different in shape and size so that the whole structure of the cryocooler is irregular and the size thereof cannot be reduced. However, as the expander is embedded in the compressor, the small-sized Sterling cryocooler provided by the present invention can be reduced effectively in size which plays an important role in some applications.

DETAILED DESCRIPTION OF THE INVENTION

Figure 1:
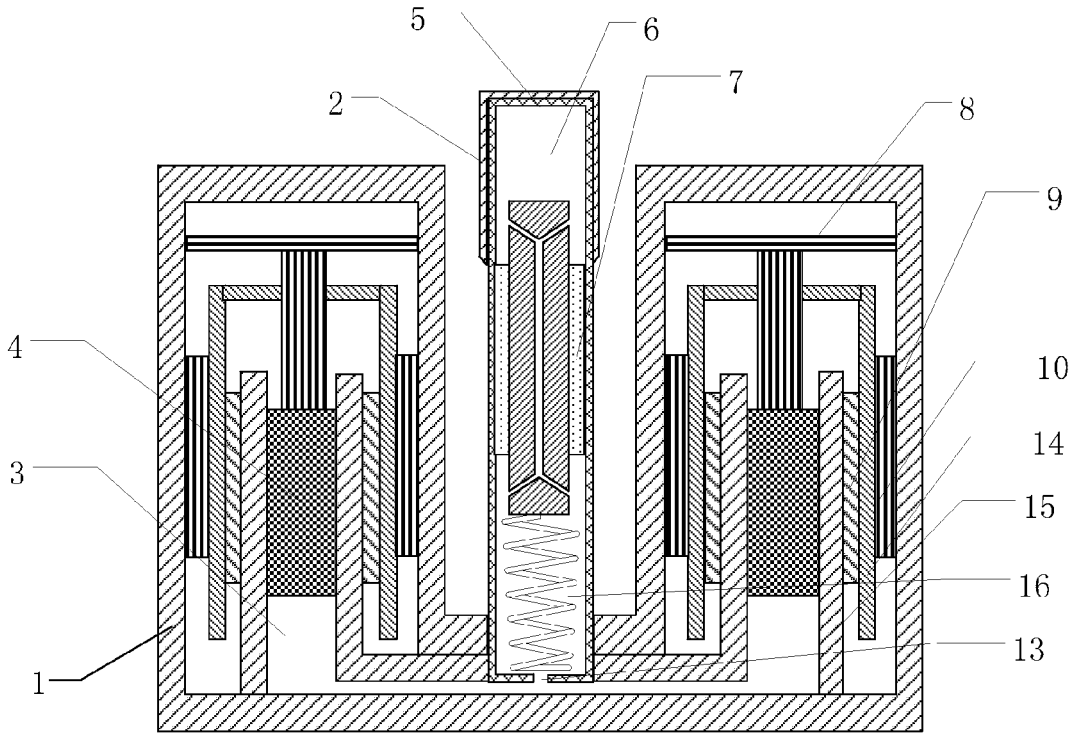
FIG. 1 is a structurally schematic view of the whole of the present invention.
Figure 2A:
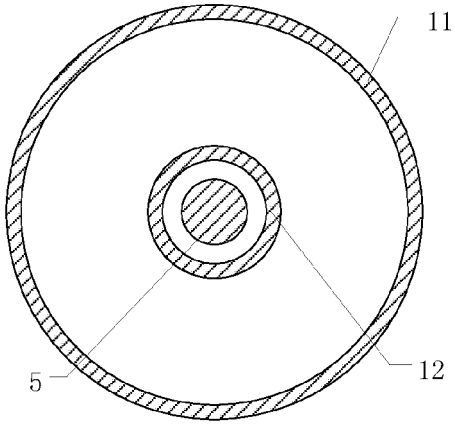
FIG. 2*a* is a cross-sectional view of a compression cavity.
Figure 2B:
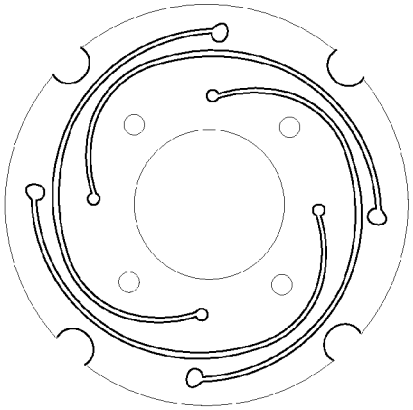
FIG. 2*b* is a schematic view of a plate spring with round apertures.

The present invention will be described in detail with reference to the accompanying drawings:

A preferred embodiment according to the present invention is presented hereunder, and described in detail with reference to the figures to better illustrate structural features and functional characteristics of the present invention. As shown in FIG. 1, an integrated type Sterling cryocooler comprises two portions, namely, a compressor and an expander, wherein the compressor comprises a housing 1, a piston 4, a plate spring 8, a magnet 9, a coil 10, a bracket 14 and a support 15, the housing of the compressor forms an annular compression cavity 3 in a way that a cylindrical compression cavity outer housing 11 is provided around a cylindrical compression cavity inner housing 12, and a cross-sectional view of the compression cavity is shown in FIG. 2*a*; the piston 4 is connected to the plate spring 8, the plate spring 8 is structured as shown in FIG. 2*b* to support a reciprocating movement of the fixed piston to compress gas, the coil 10 is fixed between the interior of the housing 1 and the bracket 14, the magnet 9 is fixed between the bracket 14 and the support 15, the bracket 14 and the support 15 are respectively connected to the housing 1, an electromagnetic force is generated between the coil 10 and the magnet 9 to drive the piston 4 into reciprocating movement; an interior of the expander is divided into two chambers, namely, an expansion chamber 6 and a pneumatic chamber by a small piston and a heat regenerator 7 which are fixed together, a cylindrical spring 16 is disposed at a bottom of the expander, compressed gas pushes the heat regenerator 7 on the small piston into reciprocating movement between the pneumatic chamber and the expansion chamber, the heat regenerator 7 is in clearance labyrinth sealing with a cold finger, a supporting element for pushing the small piston is the cylindrical spring 16, a groove is designed at a center of the compressor, the expander 2 is embedded in the groove of the compressor, an orifice 13 is designed on the bottom of the expander so as to be communicated with the compression cavity 3 of the compressor, and a working medium is helium.

The working principle of the present invention is the same as that of an ordinary Sterling cryocooler. Through simple harmonic motion of the piston, the working medium flows alternately to and fro in the portions such as the compression cavity 3, the heat regenerator 7 and the expander 6, and the mass of the gas does not vary, whereby a closed-type inverse Sterling circulation is formed, and refrigeration capacity is outputted by a cold finger 5. The present invention is advantageous in that it not only has a high heat efficiency of an ordinary integrated Sterling cryocooler, but also a compacter structure than the ordinary integrated Sterling cryocooler and a smaller size, and it can play an important role on many application occasions.

I claim:

1. An integrated Sterling cryocooler, comprising two portions, namely, a compressor and an expander, wherein the compressor comprises a housing, a piston, a plate spring, a magnet, a coil, a bracket and a support, the housing of the compressor is designed in a way that an outer housing is provided around outside an inner housing to form a compression cavity, the piston is connected to the plate spring, the coil is fixed between the interior of the housing and the bracket, the magnet is fixed between the bracket and the support, the bracket and the support are respectively connected to the housing, an interior of the expander is divided into two chambers, namely, an expansion chamber and a pneumatic chamber by a small piston and a heat regenerator which are fixed together, a cylindrical spring is disposed at a bottom of the expander, characterized in that a groove is designed at a center of the compressor, the expander is embedded in the groove of the compressor, an orifice is designed on the bottom of the expander so as to be communicated with the compression cavity of the compressor.

* * * * *